United States Patent [19]

Wilding

[11] 3,959,962

[45] June 1, 1976

[54] METHOD OF FORMING A BULKED POLYESTER TEXTILE YARNS

[75] Inventor: Frank Wilding, Harrogate, England

[73] Assignee: Imperial Chemical Industries Limited, London, England

[22] Filed: Feb. 21, 1974

[21] Appl. No.: 444,598

[30] Foreign Application Priority Data

Feb. 23, 1973 United Kingdom ..... 8990/73

[52] U.S. Cl. ..... 57/157 F

[51] Int. Cl.[2] ..... D02G 3/38; D02G 3/04; D02G 1/16

[58] Field of Search ..... 57/140 BY, 144, 160, 57/157 F, 157 R, 157 MS, 157 TS

[56] References Cited

UNITED STATES PATENTS

| | | | |
|---|---|---|---|
| 3,091,913 | 6/1963 | Field | 57/140 BY |
| 3,410,076 | 11/1968 | Dyer | 57/140 BY |
| 3,423,923 | 1/1969 | Hume | 57/140 BY |
| 3,438,193 | 4/1969 | Kosaka et al. | 57/144 |
| 3,447,302 | 6/1969 | Field | 57/157 F |
| 3,462,813 | 8/1969 | Dyer | 57/157 F X |
| 3,691,750 | 9/1972 | Waters | 57/140 BY X |
| 3,732,684 | 5/1973 | Csok et al. | 57/140 BY |
| 3,812,665 | 5/1974 | Holland | 57/157 F X |
| 3,824,778 | 7/1974 | Flanders | 57/157 F X |

*Primary Examiner*—Donald E. Watkins
*Attorney, Agent, or Firm*—Roderick B. Macleod

[57] ABSTRACT

A bulked polyester textile yarn composed of drawn helically crimped bicomponent continuous filaments and drawn substantially uncrimped continuous homofilaments is made by interlacing and substantially simultaneously relaxing a mixture of (A) potentially crimpable, drawn bicomponent filaments and (B) drawn continuous homofilaments, the filaments (A) having greater potential shrinkage than filaments (B).

9 Claims, 2 Drawing Figures

METHOD OF FORMING A BULKED POLYESTER TEXTILE YARNS

The present invention relates to bulked polyester textile yarns.

According to the present invention, a process for the production of a bulked polyester textile yarn comprises forming a bundle composed of 25 – 75% by weight of (A) potentially crimpable, drawn bicomponent polyester continuous filaments (as herein defined) and 75 – 25% by weight of (B) drawn polyester continuous homofilaments, the filaments (A) having a greater potential shrinkage than filaments (B); and subjecting the filaments of the bundle to the action of an interlacer utilising jets of heated gaseous medium, while substantially simultaneously allowing the filaments of the bundle to relax.

Also according to the present invention, a bulked textile yarn is composed of 25 – 75% by weight of drawn helically crimped polyester bicomponent continuous filaments (as herein defined) and 75 – 25% by weight of drawn substantially uncrimped polyester continuous homofilaments.

Figure 1:
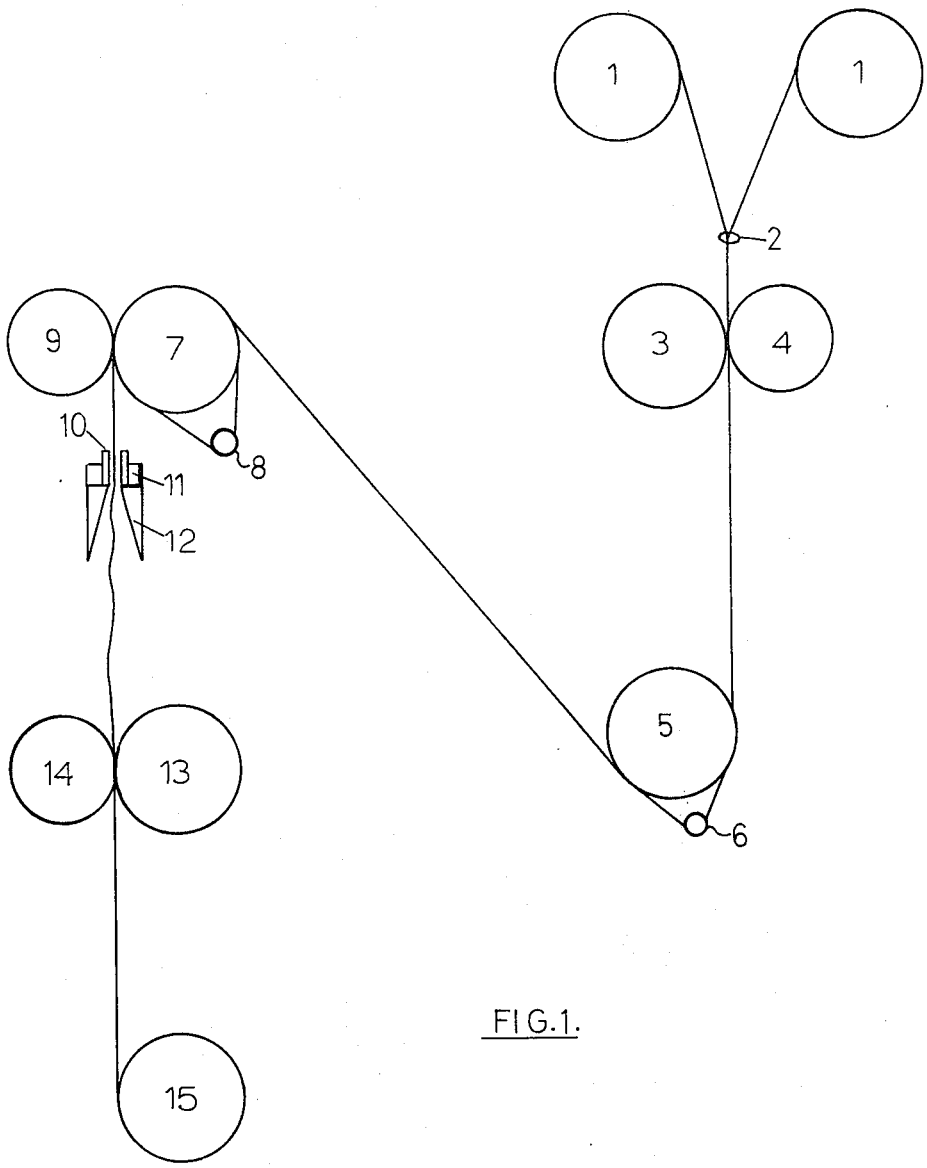

FIG. 1 illustrates diagramatically the process of the invention.

Figure 2:
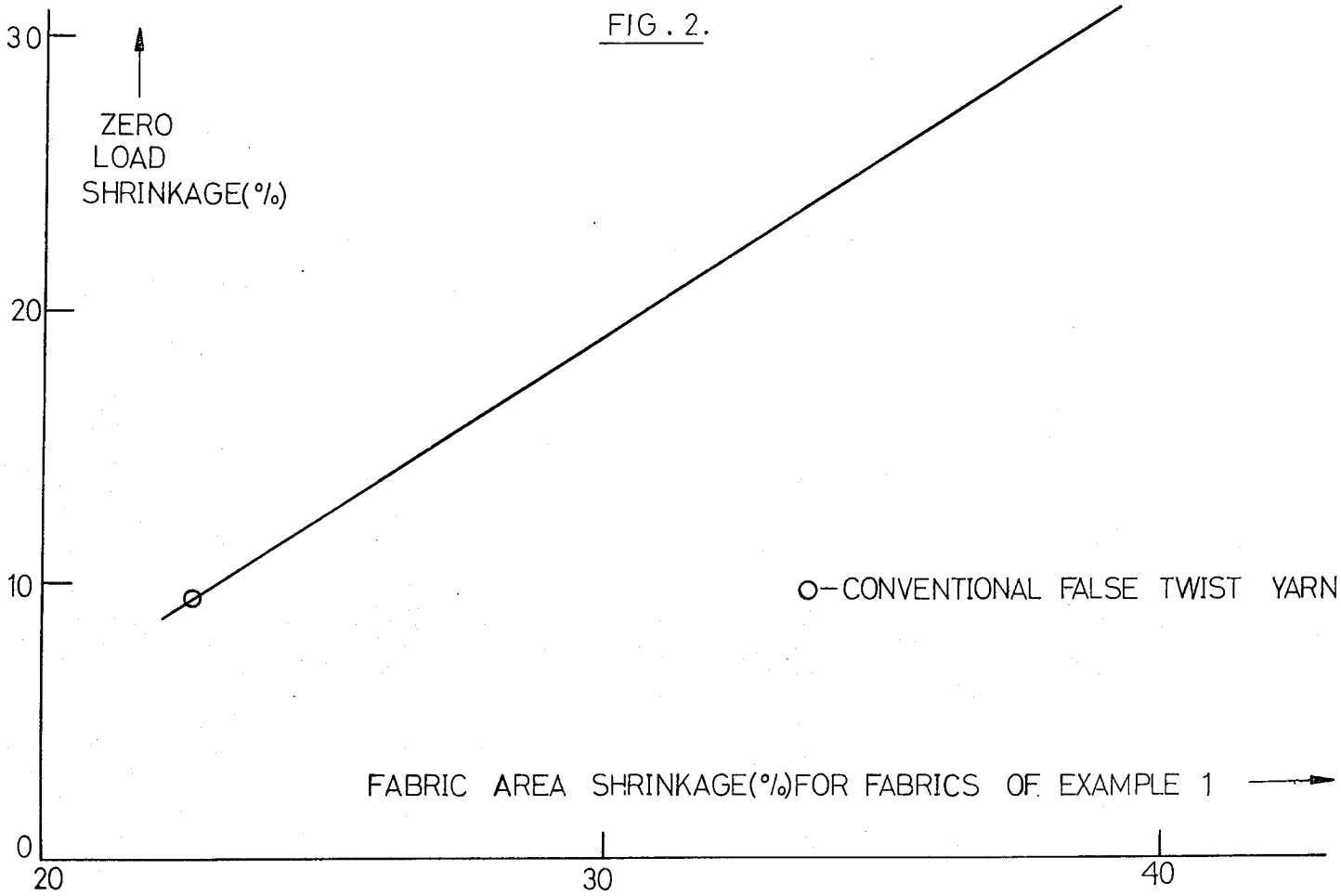

FIG. 2 compares the properties of the product of Example 1 with the prior art.

The potentially crimpable filaments (A) as utilised in the process of the invention are as defined in U.S. Ser. No. 304,777 now abandoned, and the helically crimped filaments of the product of the invention are the filaments (A) after having been subjected to shrinkage relaxation conditions.

Preferably, the potentially crimpable filaments (A) comprise 50/50 side-by-side or asymmetric sheath/core bicomponent filaments of polyethylene terephthalate and 7.5 mole % polyethylene isophthalate/polyethylene terephthalate copolymer. In the sheath/core configuration the latter polymer forms the sheath.

The bundle of filaments may be formed by spinning the homofilaments and the bicomponent filaments separately and combining them at drawing, or separately spinning the homofilaments and bicomponent filaments from adjacent spinnerets and combining them at spinning wind-up, or, the homofilaments and the bicomponent filaments may be spun from the same spinneret. In the cases where the filaments are combined at spinning, the filaments of the bundle may be slightly interlaced prior to winding to aid coherency.

Regardless of the manner of formation of the filament bundle, it is then subjected to a drawing operation. The filament bundle may be passed from a pretension roll (providing, for example, 0.5% stretch) to a heated feed roll and then to a draw roll which may optionally be heated. If desired the bundle or part of the bundle may pass in contact with a hot plate between the feedroll and the draw roll. The two filament types constituting the bundle may exhibit different drawing behaviours and as a result there may be a tendency for some of the homofilaments to lap the draw roll and break, especially at higher processing speeds. If necessary, steps may be taken to minimise this problem, for example by applying a nip roll to the surface of the draw roll or by passing the drawn yarn taken from the draw roll through a tension forwarding jet. The problem may also be alleviated by interlacing the filaments of the bundle prior to or during drawing.

The filament bundle may also be formed by drawing one type of constituent filament and feeding it to the draw roll during drawing of the other type of constituted filaments. Alternatively the two filament types may be separately drawn and subsequently combined to form the filament bundle.

The effect of the drawing stage is such that the drawn filament types in the bundle exhibit a shrinkage differential. The potential "overall" shrinkage (i.e. bulk and linear shrinkage) of the bicomponent filaments is greater than the linear shrinkage of the homofilaments. In accordance with another aspect of the invention it is desirable that the shrinkage of the bicomponent filaments (measured in air at 150°C at 1 mg/decitex load) is at least 5% and not greater than 30% more than the free (zero load) shrinkage of the homofilaments. Below 5% difference desirable yarn characteristics (described hereinafter) are not attained and above 30% difference the yarn produced is difficult to knit on conventional knitting machines. Preferably the shrinkage differential is from 10% to 30% and more preferably from 15% to 25%. The shrinkages of the constituent filaments of the bundle are governed by the choice of the normal parameters e.g. intrinsic viscosity, birefringence, heated feed roll temperature, plate temperature and draw ratio, as is well known to the skilled man.

From the draw roll, the drawn filament bundle is fed to an interlacer utilising jets of heated gaseous medium which interlaces the yarn and preferably has a forwarding action and some twisting action on the bundle. According to a preferred embodiment of the invention, the interlacer is mounted into the entry of a conical expansion chamber (to prevent non-turbulent flow of the gaseous medium) wherein the heated gaseous medium, preferably and conveniently air, is utilised as a relaxing agent. The cone angle of the expansion chamber is preferably in the range 6° to 35°. The filament bundle is subsequently passed around a relax roll running at a peripheral speed slower than that of the draw roll. Without the use of conical expansion chamber, a less than adequate degree of relaxation of the filaments may be obtained.

The temperature of the air fed to the interlacer is in the temperature range 170°C to 250°C, and the air may be caused to flow also about the external metal surface of the expansion chamber to heat it. A temperature within the range 210°C to 240°C is preferred, particularly 230°C.

The drawn relaxed yarn of the invention is a bulked textile yarn having compact zones wherein substantially the whole of the homofilaments is wrapped about and interlaced to some extent with the bicomponent filaments which exhibit a helical crimp, alternating with loopy zones wherein the loops (non-crunodal) are formed by the homofilaments extending longitudinally of and outwardly separated from the bicomponent filaments. Preferably, the yarn of the invention is composed of 50% by weight of each of the filament types. Desirably, the bulked textile yarn exhibits between 30 and 100 loopy zones per meter, and preferably between 40 to 80 loopy zones per meter.

The quantity of loopy yarn, the loop sizes, and the overall bulkiness of the yarn are affected by the relax ratio used in the process, and the relax ratio selected is dependent upon the properties of the drawn filament bundle, the air flow and the structure of the product required. For the present invention a typical range from which to select a relax ratio is 1.35:1 to 1.75:1.

The actual air flow through the interlacer/expansion chamber system must be sufficient to provide interlacing, twisting and heat setting of the filament bundle at the temperature of the heated air.

Air flows which have been found to give desirable results lie in the range 20 to 80 cubic feet per hour (measured at the mouth, ie. exit, of the expansion chamber), preferably 40 to 65 cubic feet per hour. At low air flows there is inadequate forwarding of the filament bundle; at high values the resultant yarn becomes "nubby" due to the excessive turbulence created.

The relaxed yarn should preferably be cool before winding up takes place. A constant tension winder may be used, a convenient tension range being from 2 to 25 gm per decitex. Wind-up tension may of course alter the physical dimensions and disposition of the loops in the yarn, and may be utilised to affect the structure of the yarn being produced.

The bulkiness and loop development in the yarns of the invention may be enhanced by relaxing in fabric form after production of the fabric.

The loopy zones of the yarn of the invention have lengths varying between less than 0.25 cm and greater than 2.0 cm. Preferably, at least 70% of the loopy zones have lengths in the range 0.3 cm to 1.25 cm, and less than 5% of the loopy zones have lengths greater than 1.5 cm. Desirably, the maximum length of a loopy zone does not exceed 1.75 cm.

The loopy zones have widths varying between less than 0.1 cm and greater than 0.3 cm. Preferably, at least 65% of the loopy zones have widths in the range 0.1 cm to 0.3 cm and less than 10% greater than 0.35 cm.

The yarns of the invention have desirable properties which, for example, when knitted into fabrics, produce fabrics of exceptionally good handle reminiscent of staple fibre fabrics.

By having the constituent filament types differing in colour it is possible to produce a yarn of the invention which exhibits a marl effect.

The invention will be further described with reference to the following Examples:

EXAMPLE 1

A heterofilament yarn was prepared by spinning 0.675 dl/gm IV., 7½ mole % polyethylene isophthalate-polyethylene terephthalate copolymer with 0.485 dl/gm IV polyethylene terephthalate homopolymer in an extreme asymmetric sheath and core relationship; the latter polymer forming the core. The polymers were spun at 290°C, using a wind up speed of 1230 mpm, to a mean birefringence of $8 \times 10^{-3}$. The yarn was dressed with a spin finish, contained 30 filaments and had a final decitex of 506.

This yarn is designated A.

A homofilament yarn was prepared by spinning a 0.675 dl/gm IV polyethylene terephthalate polymer under the same conditions as those for Yarn A. The yarn had a birefringence of $8 \times 10^{-3}$, 30 filaments and a gross decitex of 506.

This yarn is designated B.

A second homofilament yarn was prepared by spinning a 0.485 dl/gm IV polyethylene terephthalate polymer under the same conditions as those for Yarn A. The yarn had a birefringence of $6.3 \times 10^{-3}$, 30 filaments and a gross decitex of 506.

This yarn is designated C.

Yarn A combined at the creel with either Yarn B or Yarn C was draw textured on the equipment depicted in FIG. 1. Yarns from the bobbins of spun yarn 1 are brought together at the guide 2 from where they pass to the pretension roll 3 fitted with a rubber surfaced nip roll 4. The plied yarns then pass to the heated feed roll 5 fitted with a separator roll 6 before passing to the draw roll 7 fitted with separator roll 8 and rubber covered nip roll 9. After the draw roll the yarns go through a forwarding interlacer 10, mounted in a block 11 which is supplied by hot air, and which is mounted on top of an expansion cone 12. The yarns are then taken to a windup 15 via a relax roll 13 fitted with a rubber covered nip roll 14.

In these experiments the interlacer had a 0.125 inch diameter yarn passageway and had two holes of 0.04 inch diameter, at 77° to the axis of the yarn passageway, and at 45°C to each other, carrying air to the centre of the interlacer. The expansion cone had an 8° taper. In all cases the yarn was drawn to a draw ratio of 3.22 with a heated feed roll surface temperature of 88°C.

Yarn combinations A + B and A + C were run on the equipment described above at a drawspeed of 760 mpm (with a few exceptions defined below) and a relax ratio of 1.45 (1.6 at 80 cfh air flow). The temperature of the air fed to the interlacer ranged from 170°C to 240°C and the air flow from the bottom of the expansion cone, measured with a rotameter, varied from 40 to 80 cubic feet an hour (NTP). Yarns produced at air temperatures below 200°C did not run readily, under the above conditions at air flows below 55 cfh and at drawspeeds above 600 mpm.

The shrinkage differential between A and B was 15% and between A and C 19%.

All the yarns produced were covered with relatively small loops of homofilament yarn and visually were of similar appearance.

The yarns were knitted up to a medium quality on a 21 gauge fully fashioned knitting machine to give fabric panels. These fabrics were dyed by the following route, with all wet processes being done in a paddle dyeing machine at atmospheric pressure:

1. Scour 60°C for 30 minutes.
2. Rinse
3. Centrifuge out excess water then tumble dry at 125°C for 15 minutes.
4. Steam press at 125°C.
5. Steam set in 2 × 10 minute cycles at 130°C.
6. Dye at 95°C for 60 minutes.
7. Reduction clear at 55°C for 20 minutes.
8. Soap at 60°C for 20 minutes.
9. Soften.
10. Centrifuge out excess liquid then tumble dry at 125°C for 15 minutes.
11. Steam press at 125°C.

The area shrinkage of the fabric at the end of these processes was determined as a percentage of the area of the grey state fabric. This was found to be related to zero load yarn shrinkage (S) as shown in FIG. 2; the exact relationship depends on fabric structure and processing. Data for a typical fabric from a conventional false twist polyethylene terephthalate crimped yarn is included. In general zero load shrinkage decreases as air temperature and air flow increase.

Fabrics made from yarns relaxed at the lower temperatures had a fuller handle than those made at a higher air temperature.

Fabrics made from Yarn A + Yarn B in general had fewer and smaller surface loops than those from Yarn A + Yarn C.

Fabrics made from yarns processed at the higher temperatures and higher air flows tended to have more and larger surface loops than those made at the lower temperatures and air flows. The fabrics made at air flows above 55 chf and particularly at 80 cfh had small nubs distributed throughout them.

All the fabrics were staple like in handle to varying degrees but were all more so than the fabric from the conventional false twist polyethylene terephthalate false twist yarn.

EXAMPLE 2

This example illustrates the effect of using a homofilament component of low shrinkage.

Yarn B of Example 1 was drawn at 600 mpm on a conventional drawtwist machine at a draw ratio of 3.22 using a feed roll surface temperature of 87°C and a hot plate set at 175°C.

This yarn is designated D.

Yarn A of Example 1 was passed through the equipment of FIG. 1, at 3.22 draw ratio and 88°C feed roll surface temperature, at 760 mpm drawspeed, and Yarn D was fed into the threadline at the drawroll so that Yarn A and Yarn D entered the relax zone at the same velocity. The two yarns were relaxed and wound up together using a relax ratio of 1.45. An air temperature of 230°C and air flow of 50 chf were used for the relax tube. The shrinkage differential between Yarns A and D was 24%.

This yarn is designated E.

A second yarn was made by feeding Yarn A and Yarn C of Example 1 together through the equipment of FIG. 1 with the two spun yarns being plied at the creel. The relax conditions used for Yarn E were used. This gave a yarn designated Yarn F. The shrinkage differential between the two yarns was 19%. The drawing conditions were as in Example 1.

Yarn E was much loopier and contained bigger loops than Yarn F. Yarn E gave a medium quality fully fashioned fabric which after drying, as described in Example 1, had a much more loopy and staple like surface than a medium quality fully fashioned fabric from Yarn F. Yarn E was more difficult to knit than Yarn F.

EXAMPLE 3

This example illustrates the effect of using a heterofilament yarn which falls outside U.S. Ser. No. 304,777, and has an inadequate differential retraction energy.

A heterofilament yarn was prepared by spinning 0.675 dl/gm IV polyethylene terephthalate with 0.485 dl/gm IV polyethylene terephthalate in an extreme asymmetric sheath and core relationship; the latter polymer forming the core. The polymers were spun at 290°C, using a wind up speed of 1230 mpm., to a mean birefringence of $8 \times 10^{-3}$. The yarn was dressed with a spin finish, contained 30 filaments and had a final decitex of 506. This yarn is designated J. The differential retraction energy of drawn yarn from this yarn, using a feed roll surface temperature of 87°C and a draw ratio of 3.22, is 0.45 ergs/dtex/cm according to U.S. Ser. No. 340,777 but falls outside the scope thereof.

Yarn A of Example 1, when drawn under the same conditions as Yarn J, gives a drawn yarn of differential retraction energy 2.0 ergs/dtex/cm according to and falls within the scope thereof.

Yarn J when plied at the creel with Yarn C of Example 1 and processed on the equipment of FIG. 1 at a relax temperature of 230°C and air flow of 50 cfh using a drawspeed of 450 mpm would not process satisfactorily at relax ratios greater than about 1.25.

Yarn A + Yarn C of Example 1 when processed as Yarn J plus Yarn C above, but at a drawspeed of 760 mpm, ran readily at a relax ratio of 1.45.

Compared with the product based on Yarn A that from Yarn J was less bulky and gave a lean fabric (medium quality fully fashioned), it was also less loopy, and gave a fabric with less surface loopiness and less staple like handle.

EXAMPLE 4

A homofilament yarn was made as Yarn B of Example 1 except that it contained 0.5% (wt) of Foron Rubine S-2GFL dyestuff which was introduced at spinning. This gave a yarn designated Yarn G.

Another yarn was made as Yarn G except that it contained 0.5% (wt) Waxoline Green G dyestuff. This yarn was designated Yarn H.

Yarn G, Yarn H, and Yarn A of Example 1 (which contained 0.5% titania delustrant and no colourant) were plied at the creel and drawrelaxed on the equipment of FIG. 1, at 760 mpm drawspeed, using a relax ratio of 1.45, an air temperature of 230°C and an air flow rate of 55 chf in the relax tube.

The resulting yarn was loopy and gave an attractive three colour marl fabric (medium quality fully fashioned) with staple like handle.

The methods utilised for the measurement of the various shrinkages are as follows:

SHRINKAGE UNDER 1 MG/DTEX LOAD OF BICOMPONENT FILAMENT YARN $10 \times 1$ meter wraps of drawn yarn are wound off onto a wrap wheel and the yarn ends tied together. The yarn is removed from the wrap wheel and the skein length under a load of 1 mg/ dtex ($l_1$) determined. The skein length is found by suspending the skein from a 1 mm diameter metal rod mounted horizontally at the top of a vertically mounted ruler. After determining $l_1$ the yarn is suspended, still under a load of 1 mg/ dtex, from a 1 cm diameter metal rod mounted horizontally on a clamp stand. The distance between the metal rod and the clamp stand is such that the weight suspended from the skein of yarn swings freely. The clamp stand is then placed in a hot air oven, maintained at 150°C and with fans circulating the air, for 2 minutes. The yarn is removed from the oven and the skein length $l_2$, under 1 mg/ dtex determined against the vertical ruler as before. The loads are calculated in mg/ flat dtex of the unshrunk yarn.

The shrinkage is calculated as:

$$\text{Shrinkage} = \frac{l_1 - l_2}{l_1} \times 100\%$$

FREE SHRINKAGE OF HOMOFILAMENT YARN

One meter of yarn is tied in a loop. The loop length ($l_3$) is determined by suspending it, under a load of 60 mg/ dtex, from a 1 mm diameter metal rod mounted horizontally at the top of a vertically mounted ruler.

The load is then removed from the yarn and the yarn is suspended from a 1 cm diameter metal rod mounted horizontally on a clamp stand; it does not touch the clamp stand. The clamp stand is then placed in a hot air oven, maintained at 150°C and with fans circulating the air, for 15 minutes. After removing the yarn from the oven the loop length ($l_4$) is determined as before.

The shrinkage is calculated as:

$$\text{Shrinkage} = \frac{l_3 - l_4}{l_3} \times 100\%$$

ZERO LOAD SHRINKAGE (S)

10 × 1 meter wraps of yarn are wound onto a wrap wheel and the ends tied together. The yarn is removed from the wrap wheel and the skein length ($l_5$) under a load of 0.09 g/ dtex, determined by suspending it against a vertically mounted ruler. The load is then replaced by another load of 0.06 mg/ dtex and the yarn suspended freely in boiling water for 15 minutes. The skein is then dried carefully with blotting paper and its length ($l_6$) determined under a load of 0.09 gp/tex. The loads are calculated as mg/ flat dtex of the unshrunk yarn.

$$\text{Zero Load Shrinkage } (S) = \frac{l_5 - l_6}{l_5} \times 100\%$$

What we claim is:

1. A process for the production of a bulked polyester textile yarn comprising forming a bundle composed of 25–75% by weight of (A) potentially crimpable, drawn bicomponent polyester continuous filaments and 75–25% by weight of (B) drawn polyester continuous homofilaments, the filaments (A) having a greater potential shrinkage than filaments (B); and subjecting the filaments of the bundle to the action of an interlacer untilizing jets of heated gaseous medium at a temperature of from 170°C to 250°C while substantially simultaneously allowing the filaments of the bundle to relax.

2. A process according to claim 1, wherein the action of the jets of heated gaseous medium serves to forward the bundle and to interlace and twist the filaments thereof.

3. A process according to claim 1, wherein the bundle on leaving the interlacer is passed immediately into a conical expansion chamber wherein the heated gaseous medium is utilised as a relaxing agent.

4. A process according to claim 1, wherein said temperature is in the range 210°C to 240°C.

5. A process according to claim 3 wherein the flow of the heated gaseous medium (measured at the exit from the expansion chamber) is in the range 20 to 80 cubic feet per hour.

6. A process according to claim 5, wherein said flow is in the range 40 to 65 cubic feet per minute.

7. A process according to claim 3, wherein the cone angle of the expansion chamber is in the range 6° to 35°.

8. A process according to claim 1, wherein the filaments in the filaments in the bundle are subjected to a relax ratio in the range 1.35:1 to 1.75:1.

9. A process according to claim 1, wherein the shrinkage of the bicomponent filaments (measured in air at 150°C at 1mg/decitex laod) is at least 5% and not greater than 30% more than the fall (zero load) shrinkage of the homofilaments.

* * * * *